US005803188A

United States Patent [19]

McInnes

[11] Patent Number: 5,803,188

[45] Date of Patent: Sep. 8, 1998

[54] HYDRAULICALLY DRIVEN PERCUSSION HAMMER

[75] Inventor: Malcolm Bicknell McInnes, Angle Vale, Australia

[73] Assignee: SDS Pty Ltd., Australia

[21] Appl. No.: 539,726

[22] Filed: Oct. 5, 1995

Related U.S. Application Data

[63] Continuation-in-part of PCT/AU94/00165, May 4, 1994, published as WO94/23171, Oct. 13, 1994.

[30] Foreign Application Priority Data

Apr. 5, 1993 [AU] Australia ..... PL8157

[51] Int. Cl.[6] ..... E21B 4/14

[52] U.S. Cl. ..... 175/92; 173/126; 175/296

[58] Field of Search ..... 175/296, 92; 173/112, 173/126, 212, 78

[56] References Cited

U.S. PATENT DOCUMENTS

| | | | |
|---|---|---|---|
| 2,979,033 | 4/1961 | Bassinger | 175/296 |
| 3,487,752 | 1/1970 | James | 173/212 |
| 4,660,658 | 4/1987 | Gustafsson | 175/296 |
| 5,497,839 | 3/1996 | Moir | 175/296 |
| 5,542,484 | 8/1996 | McInnes | 175/296 |

FOREIGN PATENT DOCUMENTS

| | | | |
|---|---|---|---|
| 1439187 | 11/1988 | Russian Federation | 175/92 |
| 89/00638 | 1/1989 | WIPO . | |
| 92/01138 | 1/1992 | WIPO . | |
| 92/12323 | 7/1992 | WIPO . | |
| 93/20322 | 10/1993 | WIPO . | |

*Primary Examiner*—Hoang C. Dang
*Attorney, Agent, or Firm*—Michael N. Meller

[57] ABSTRACT

An hydraulically driven percussive hammer for use with down-the-hole percussive hammer drilling, the hammer having a piston and liner combination which provides for multiple stages where there are successive effective piston drive areas of diminishing size for both return and impact directions which minimizes peak pressures from hydraulic hammer effects.

11 Claims, 5 Drawing Sheets

HYDRAULICALLY DRIVEN PERCUSSION HAMMER

This application is a continuation -in-part of PCT/AU94/00165 filed Apr. 5, 1994.

This invention relates to percussion drilling Improvements and in particular to the case where such drilling apparatus is driven by liquid at pressure.

It has previously been known to use in-the-hole reciprocating percussive motors which are driven by air pressure.

There are advantages possible by using liquid (usually water) instead of air but problems have been experienced in trials when an in-the-hole liquid driven percussive motor is used.

One of these problems to which this invention is directed relates to the problem conventionally known as water hammer which is the mechanical shock resulting from the generation of high pressure peaks when the velocity of a long column of water is caused to be rapidly changed.

Such high pressure peaks can place great stress on seals and other constraining parts.

A number of differing techniques have been tried in order to adequately reduce the pressure peaks which would result if conventional equipment is used.

Previous trials have included a column of air to act as a buffer. Such an arrangement has not worked successfully when trialed over an extended period of time. Other attempts have included the use of other buffering devices but again where metal components have been used metal fatigue has caused a high and early failure rate.

The object of this invention is to provide a different arrangement from those previously used by which a reduction in the pressure peaks can be achieved.

According to this invention this can be said to reside in a percussive hammer to be used for in-the-hole hammer percussive drilling using liquid pressure to drive the percussion hammer characterised in that the hammer includes a piston member within a cylinder adapted to move through at least two stages during its impact stroke where during one stage there is provided an effective piston area which is different from that of the effective piston area offered during the other stage, the hammer being arranged such that supply of liquid pressure during the stage with the lesser effective piston area will be connected only subsequent to the supply of liquid pressure being supplied during the stage with the larger area where the two stages are while the piston member is caused to outwardly accelerate to an impact location.

In this way, the flow rate of supply fluid required to accelerate the piston member during successive stages would be reduced if this piston started each new stage at rest. However, because the piston is increasing its speed, the smaller effective piston area will result in a more constant flow rate.

There will be achievable therefore a flow rate of the liquid overall which will be less subject to abrupt change and hence cause of any high pressure peaks.

In preference, there is also provided such an arrangement for the return stroke to be handled in the same way as the impact stroke.

In preference, the number of stages used is increased above two both for the outward stroke and the return stroke of the piston member.

In preference, the liquid used is water.

In preferable alternative, there are provided two piston members within the same cylinder arranged to act in mutually opposing directions and where one of the piston members provides a cylinder shape to interact with the other piston member as a cylinder.

In preference, where there are two piston members within the same cylinder, there is provided a chamber filled with water and within which each of the piston members defines a part of the chambers area with an effective piston area equal to that of the other piston member and where the chamber is closed to external access and is filled with water.

The result of this last arrangement is to constrain the respective motions of the two piston members to maintaining a common volume within the chamber and hence substantially hydraulically interlock the relative motion directions of the two members to respectively reciprocate.

In preference, there is arranged to be met at the end of the return stroke of the piston member a closed chamber filled with water to act as a return stroke buffer.

For a better understanding of this invention it will now be described with reference to the preferred embodiments which shall be described with the assistance of drawings in which.

Figure 6:
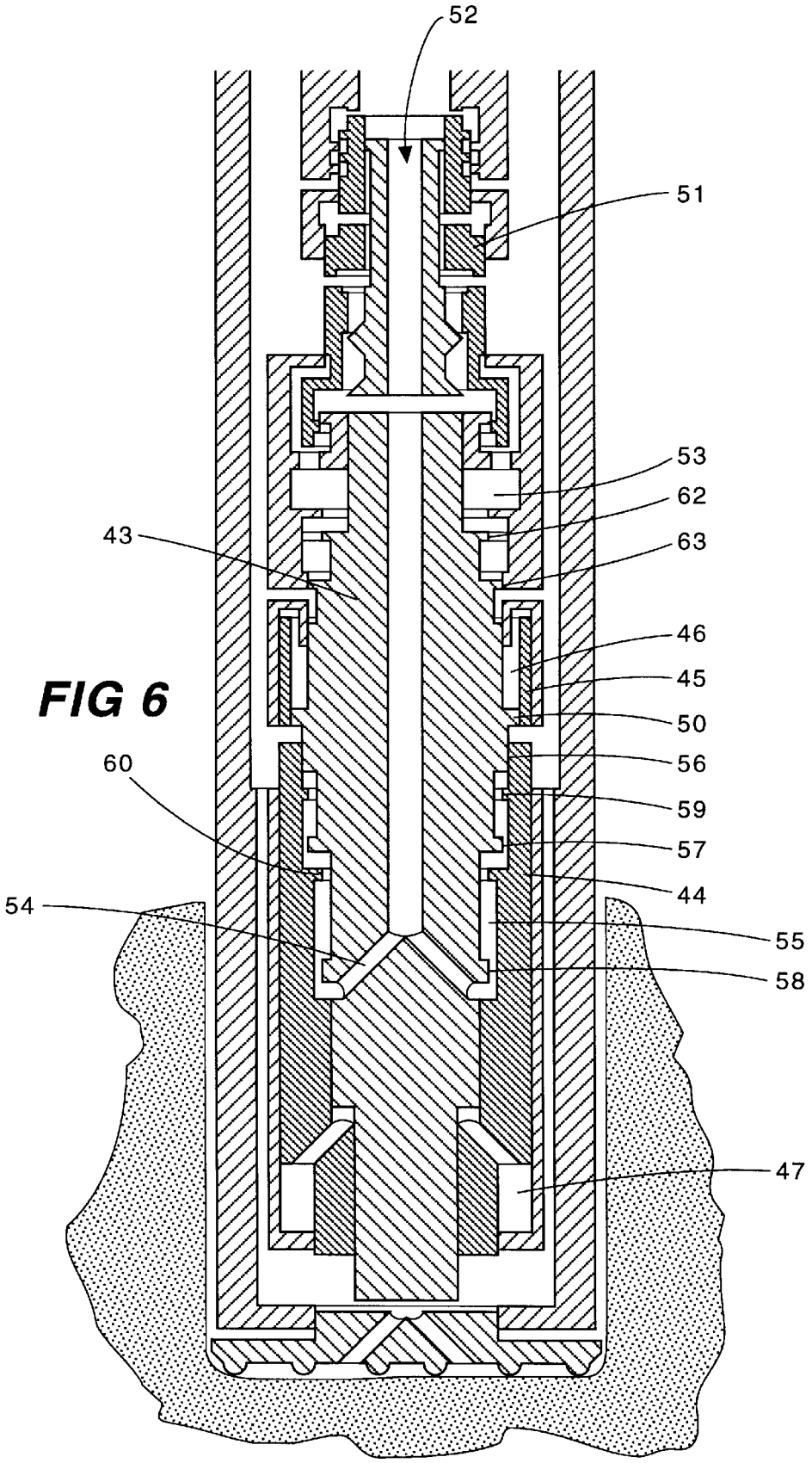
FIG. 6 is an arrangement according to a second embodiment shown schematically being a dual piston percussive motor with three stages per stroke.
Figure 7:
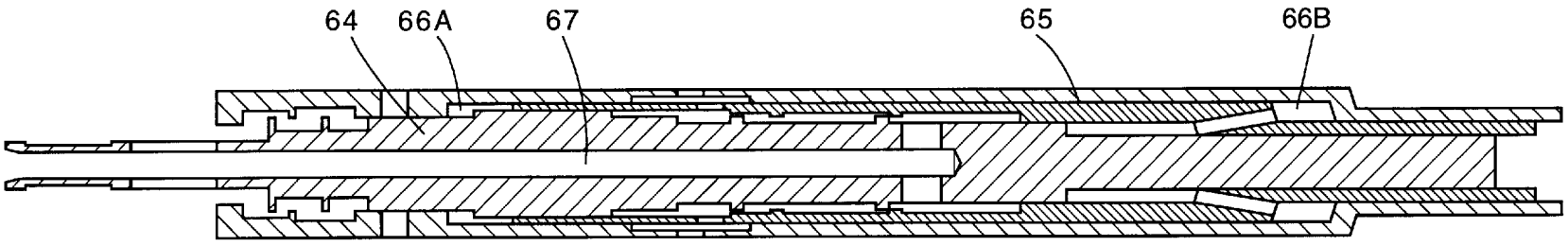
Figure 8:
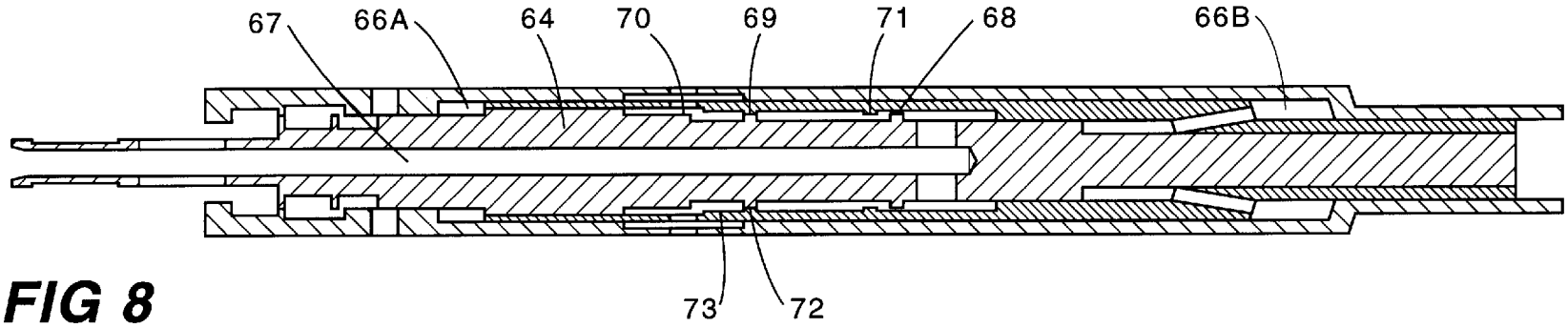
Figure 9:
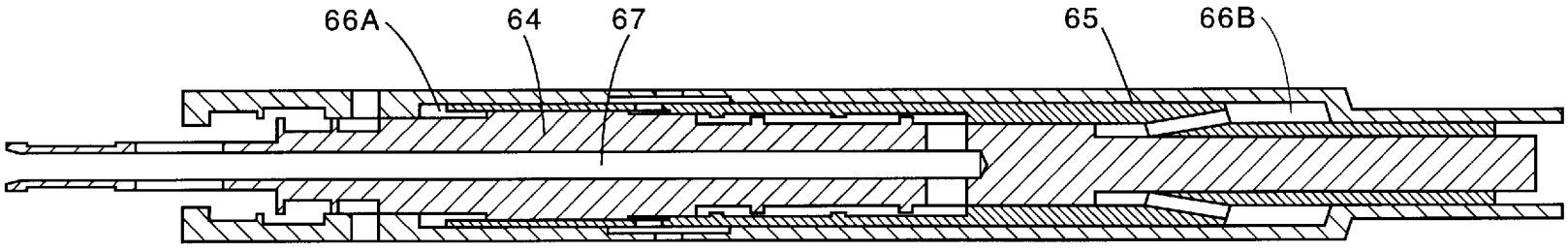
Figure 10:
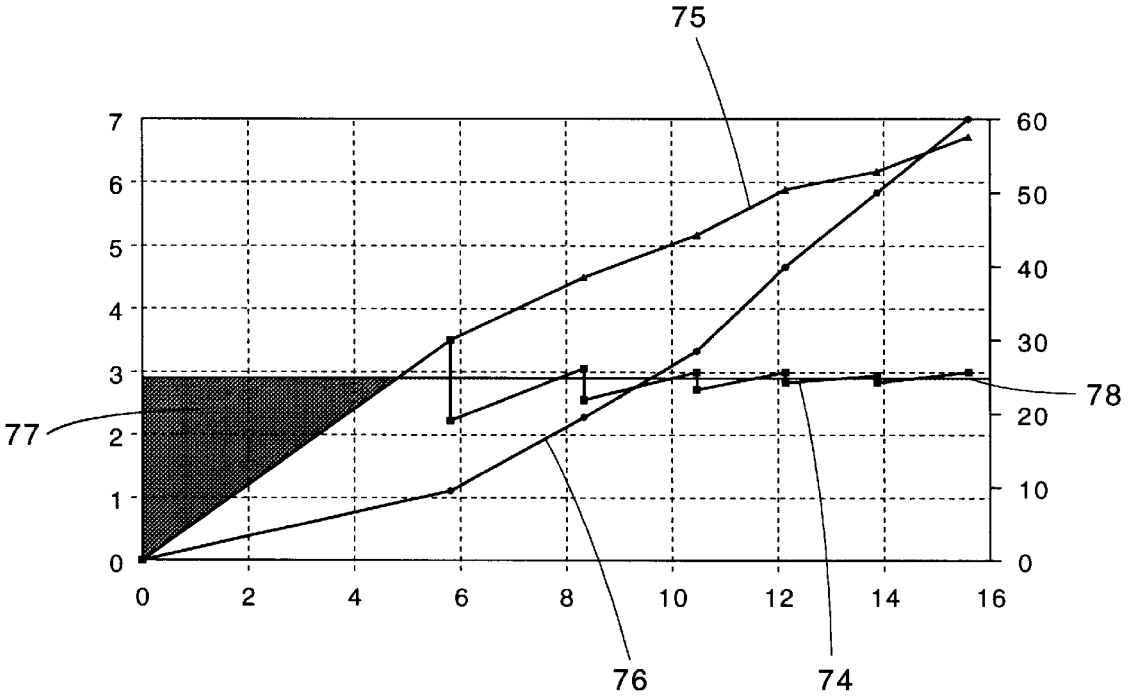

FIGS. 7, 8 and 9 are cross sectional views of a percussive hammer being a three stage per stroke dual piston hammer according to a second embodiment the drawings being somewhat schematic and being shown without any valve arrangement but intended to be using a valve system such as illustrated in FIG. 6; and FIG. 10 illustrates graphically the improvements achieved in reduction of flow rate variation with the present invention.

Figure 1:
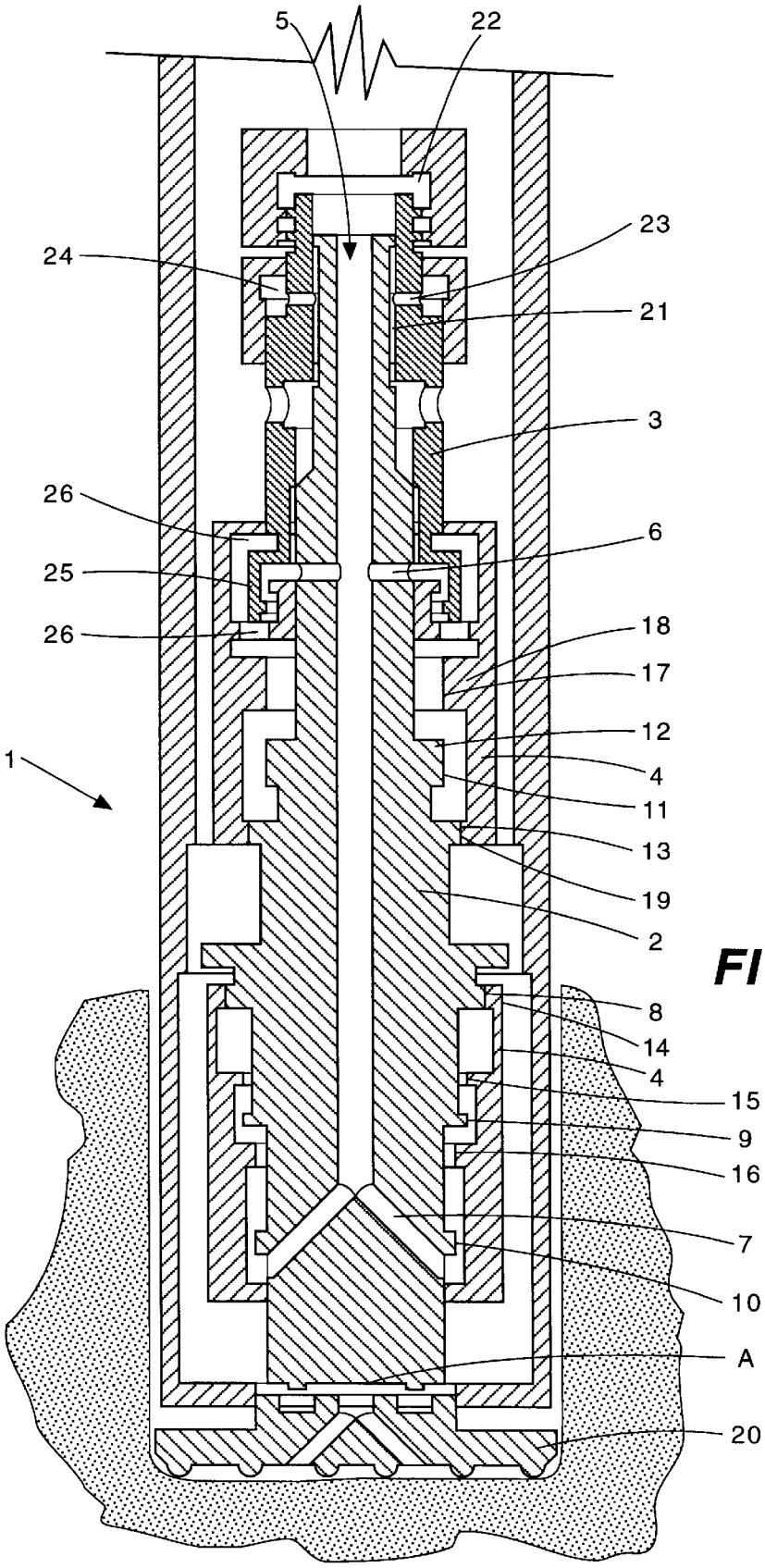
FIG. 1 is a schematic cross sectional view shown schematically only of a percussion hammer according to a first embodiment incorporating a valve to effect reversal of flow.

Referring to the drawings in detail there is shown in FIG. 1 in a schematic arrangement, a percussive hammer 1 which includes a piston member 2, a valve member 3 and a cylinder 4.

The piston member 2 has a central passageway 5 with outlets at 6 and 7 for supply of water at substantial pressure.

Surrounding the piston member 2 is a cylinder 4 having a plurality of liner elements with the piston member 2 having a plurality of radially projecting drive areas which form radially projecting surfaces, at least some of which have different surface areas, spaced along the outer surface of the piston member 2 for engagement with the plurality of liner elements of the cylinder 4.

Surrounding the piston member 2 and defining with respective piston segments of the piston member 2 is the cylinder 4.

The piston member 2 has a plurality of drive areas 8, 9 and 10 at one end of the piston member 2 and another plurality of piston drive areas 11, 12 and 13 at the other end of the piston member 2. These piston drive areas are selected so that as they are each presented with water at pressure by reason of their respective coincidence with an inward extending liner element of the cylinder. The plurality of drive areas of the piston member 2 engage the liner elements 14, 15 and 16 of cylinder 4 in one piston position along the cylinder 4 and the liner elements 17, 18 and 19 of cylinder 4 in another piston position, where there is thereby provided an effective piston drive area which as the piston member 2 is being caused to accelerate toward an outermost impact location which is to say the end at A will impact the simulated bit at 20 then each effective piston drive area which will be acted upon by fluid at pressure will be smaller.

As will be seen by the schematic drawing of FIG. 1 there are therefore six different effective piston drive areas. The piston member 2 begins its return stroke after striking the bit at 20 (with piston drive areas 11, 12 and 13 being exposed at the same time to exhaust pressure). By having effective pressure from the high pressure water supply passing through conduit 5 and through outlets 7 and by-passing piston drive areas 10 and 9 there is applied pressure to the largest effective piston drive area at 8 through cylinder 4. As the piston member 2 therefore is caused to accelerate toward its inward location, the next piston drive area 9 comes into coincidence with cylinder liner element 15 which thereby defines a smaller effective piston drive area. The next piston drive area 10 comes into coincidence with cylinder liner element 16 on cylinder 4.

The distance between the respective piston drive area and their relative location for coinciding will be cylinder liner elements such that as a first effective and largest piston area comes out of coincidence, the next one is located so that there is effectively a seamless transfer. Therefore there can be caused minimal sudden abrupt stopping or starting of full flow of the liquid at pressure. In this way, the volume of liquid required to fill the cylinder area progressively decreases but this is offset by the increasing speed of the piston. Accordingly, the rate of change of flow through the period or stages of the full stroke of the piston is reduced substantially. At the end of the return stroke, the piston member 2 brings into coincidence channel 21 between the source of high pressure fluid at 22 and channel 23 in the valve member 3. This accordingly pressurises chamber 24 which has the result of causing the valve member 3 to move downwardly which in turn brings the part 25 of the valve 3 into a position which will cause a supply of pressure fluid to then enter the area at 26. This will cause area 26 to be high pressure instead of low pressure. Pistons drive area 10, 9 and 8, and the corresponding cylinder liner elements 16, 15 and 14 of cylinder 14 are successively exposed to high pressure during a forward stroke as they were during the return stroke.

At the beginning of the forward stroke, the pressure against piston drive area 11 acts to slidably engage the cylinder liner element 17 in cylinder 4 and against drive area 10 to slidably engage the cylinder liner element 16 of cylinder 4. During the second stage of the forward stroke, 15. At the end of the forward stroke, piston drive area 12 slidably engages cylinder liner element 18 and piston drive area 9 slidably engages cylinder liner element 15. In each case, of pairs of pistons acting against each other, the differential or effective piston area is reducing as the different stages engage.

In the embodiment shown in FIG. 1, pistons drive area 11 and 12 have been made the same size and cylindrical liner elements 17 and 18 become coincidental. Such an arrangement saves on overall length and can be used if the piston speed will be appropriate after reversal of direction.

Again, therefore, as the piston is caused to accelerate, successive effective piston areas are reduced through each of the three stages. This will ensure that the fluid flow will be caused to be kept at a reduced peak.

Upon impact there is again caused a change in position of the valve 3 relative to the cylinder body 4 causing the return direction of fluid flow once again through 26. Space 26 is exposed to exhaust pressure while conduit 7 continues to supply high pressure fluid to the pistons drive areas 8,9 and 10 and the corresponding cylinders liner elements 14,15 and 16.

This description is in relation to a schematic layout where the purpose of the description is to illustrate the principle by which succeeding effective piston areas can be arranged to achieve the result required.

A more practical illustration of how this will be carried out in practice is now described without a corresponding valve system being shown for sake of simplicity in FIGS. 2, 3, 4 and 5.

These four drawings show sequentially a range of positions where there can be seen their respective three stages for the outward impacting stroke and the equivalent three stages for the return stroke.

Accordingly, there is a cylinder body 27 and a piston member 28. Dumping of water through to the bit is achieved through channels 29 outside cylinder body 27 from the valve exhaust and between cylinder sets The supply of water at high pressure is achieved through the central conduit 30 through the centre of the piston member 28 to a plurality of pistons drive areas for the return stroke. It is supplied to pistons drive areas 39 and 41 from the valve for the forward stroke.

Figures 2, 3, 4, 5:
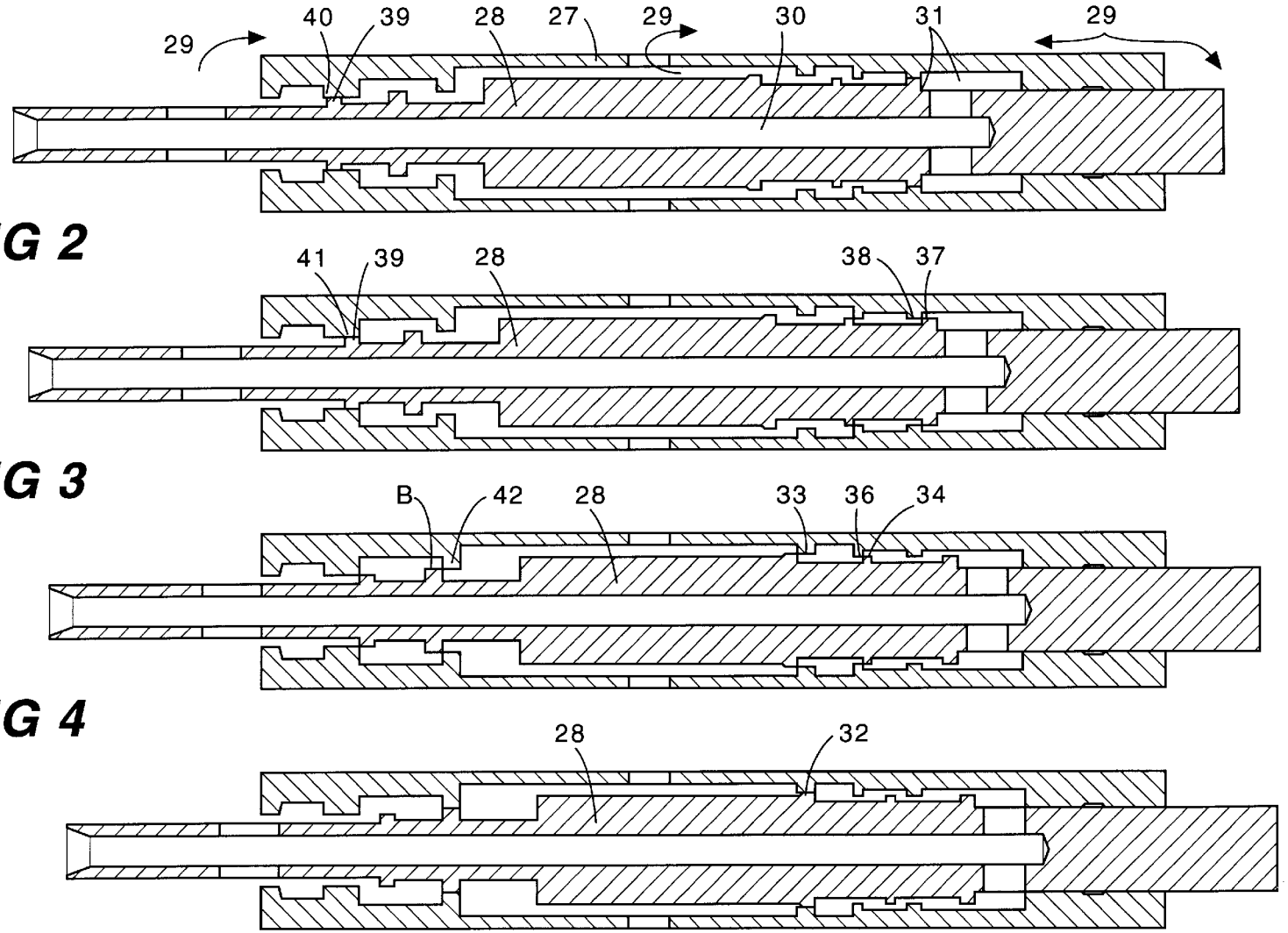
FIGS. 2, 3, 4 and 5 are cross sectional views of a piston and cylinder parts of a percussive hammer according to the first embodiment using the arrangement as schematically illustrated in FIG. 1 as a six stage single piston motor with three stages per stroke.

The water exits conduit 30 for the return stroke through channel 31 and on the return stroke firstly bears against piston drive areas 32 as shown in FIG. 5 then as this clears the cylinder liner elements 33, the next piston drive area 34 coincides with the next cylinder liner element 36 and finally piston drive area 37 coincides with cylinder liner element 38.

For the downward impacting stroke, there is firstly piston drive area 39 coinciding with the cylinder liner element 40 then piston drive area 41 with cylinder liner element 39 and finally there is coincidence of piston drive area B with the cylinder liner element 42.

Now referring to FIG. 6, this shows in schematic detail only the relative locations that can be used for a dual piston system incorporating the concept of this invention.

Accordingly in this embodiment there are provided two piston members 43 and 44.

The two piston members are kept in relative association with each other by having respective parts shown at 45 in the case of the outer piston and at 50 in the case of the inner piston 43 such that there is confined in chamber area 46 a quantity of water which will not vary. A further chamber 47 located close to the bit end A also locks the pistons together.

This effectively hydraulically couples the two piston members 43 and 44 together and causes them to act with a 180 degrees out of phase motion to cancel volume change between the bit and pistons. In this case then there is further provided a valve 51 the operation of which is substantially the same as the valve as described in relation to the embodiment described in FIG. 1 and which has for its purpose to change the direction of flow being supplied from the high pressure source at 52 to direct this into the area 53 to effect the downward stroke of the central piston member 43 while at the same time causing the reciprocal motion of the outer piston 44.

Again the function of effective piston areas is used in successive alignments so that as the respective piston that is in each case 43 and 44 is caused to accelerate respectively toward an outer impact location or toward a return location, the effective piston areas are chosen so that there would be a reduced flow rate of liquid required if the speed of the piston was kept constant but as this is accelerating, will more match the area with the speed so as to reduced substantially changes in pressure effecting water hammer effects in the pressure supply and return lines.

As will be now relatively apparent, water at pressure coming through the conduit 52 and entering through channel 54 will pass through area 55 to impinge against piston segment 56 then as the piston rises through its return stroke in succession piston segment 57 and piston segment 58 will coincide respectively with cylinder segment 59 and 80.

As the effective forces here are essentially equal and opposite, when the pressure to return the central piston member 43 is effected, this will in turn assist in providing effective force to cause the outer piston 44 to proceed through its forward stroke. During the forward stroke of the central piston there will be an initial pressure on piston segments 62 followed by segment 63. In this embodiment piston segments 62 is actually two pistons in series of the same diameter. The diameters of the pistons may of course be different.

Likewise however for the central piston there will be an initial pressure on piston segment 58 then in turn segment 59 and 56.

In this way the central piston 43 is a master piston and the outer piston 44 acts as a slave piston. The balanced counter oscillation means that there is no net change in the volume of water between the pistons and bit if the annular impact area of the slave piston equals the circular impact area of the master piston. The oscillating flows from supply to return through the pistons lower total flow losses.

A significant advantage of this arrangement is the hydraulic linkage between the two pistons enables them to move together but 180 degrees out of phase and it furthermore provides a transfer of energy so that as either piston strikes the bit, the energy of the other piston is added to the striking piston. The mass of the striking piston is effectively equal to the mass of both pistons.

This arrangement furthermore has a potentially higher operating impact frequency than the previously described single piston design. The higher frequency can be partially exchanged for a longer stroke higher piston velocity and thus a higher impact energy. The selection of the relative piston segments and the cylinder segments is also chosen to make assembly of the apparatus convenient.

For a more specific description of the dual piston three stage arrangement I now refer to FIGS. 7, 8 and 9 wherein there is shown again without a valve system for the sake of simplicity and recalling that various valve systems could be used according to known technology, there is a piston 64 acting as the master or inner piston and the outer or slave piston 65 the chambers that hydraulically interlock the master piston 64 and the slave piston 65 are shown at 66A and 66B.

There is a central supply of water provided through central conduit 67 and the respective relative locations of the piston segments at 68, 69 and 70 are matched to the effective cylinder parts at 71, 72 and 73 on the inner side of the slave piston 65.

This then describes in a general sense the way in which two embodiments can be put into place and from which will be seen that significant reduction in water hammer effect can be achieved.

There are advantages in using the dual piston system in that energy is transferred to the bit at the end of the each stroke and does not have to be stored or wasted at the end of the return stroke.

The single piston hammer does waste some energy at the end of the return stroke. The piston is "bounced" on a trapped volume of water at the end of the return stroke. During this period, some high pressure water is dumped to maintain flow and minimise water hammer. The energy in the dual piston hammer return stroke becomes impact energy. For a small energy loss penalty the valve ports fill in and round off the transitional water flow trough by allowing a metered leakage flow from supply to return when the piston is reversing and accelerating at the beginning of a stroke. Metered leakage or 'dumping' of the pressurised supply liquid is used to maintain flow during the time when the piston is slowly moving and when it is stopped at the end of each stroke and when it is accelerating after impact. If the flow is suddenly stopped, the water supply, return and flushing water columns must suddenly decelerate and then accelerate. The result is high shock loads, noise and a reduction in performance.

Now referring to FIG. 10, this illustrates based upon calculations the improvements achieved in reduction of flow rate variation and thus peak pressures.

The graph shows flow rate in liters per second and piston speed in meters per second on the left hand vertical axis, across the base, time in milliseconds and up the right hand vertical side distance travelled by the piston through six stages in millimeters.

The graph shown at 74 is the flow rate in liters per second, the speed 75 is given in meters per second and finally distance travelled is given at 76. The volume of dumped water is indicated at 77 and the average flow rate at 78.

What will clearly be seen by this graphical illustration is the significant reduction in flow rate changes by reason of the change in effective piston area sizes successively through the respective stages.

Finally the parts are in preference arranged so that the piston is bounced on a trapped volume of water at the end of the return stroke.

While the description refers to a valve to effect piston reversal other techniques are known and can be used for this function. For instance it is possible to use high pressure supply water alone to reverse the piston but the stroke would then need to be bigger for the same piston size and more energy would be lost. All of the piston kinetic energy can be lost using this concept.

It will be well understood that variations can be applicable to the specific description.

I claim:

1. An hydraulically driven percussive hammer comprising a hammer body with a percussive drill bit at one end, a liner within said body having a piston bore, a piston within said piston bore for reciprocating impact against said drill bit, a plurality of piston driving areas comprising radially projecting surfaces, at least some of which have different surface areas, spaced along the outer surface of said piston and arranged in two groups with a first group for driving said piston in one direction, and a second group for driving said piston in the other direction, each said driving area having a liner sealing surface, a plurality of piston sealing surfaces corresponding to each of said piston driving areas spaced along said piston bore engaged sequentially by said piston liner sealing surfaces, fluid conduits for delivery of hydraulic fluid to said piston driving areas comprising a first conduit for delivery of said fluid at one end of said piston and a second conduit for delivery of said fluid at the other end of said piston, and fluid control means to control flow to cause reciprocating movement of said piston, said piston driving areas and said piston sealing surfaces arranged so that, in each said direction of travel of said piston, said fluid acts sequentially against said piston driving areas with each subsequent effective piston driving area being less than the last so that the flow rate of said fluid remains substantially constant.

2. An hydraulically driven percussive hammer according to claim 1 wherein the piston and liner sealing surfaces corresponding to each of said two groups are spaced so that, during engagement of one of said corresponding piston and liner sealing surfaces in one of said groups, the piston and liner sealing surfaces of the other group are disengaged to allow fluid flow to said piston driving area of said engaged piston and liner sealing surfaces.

3. An hydraulically driven percussive hammer according to claim 2 wherein said group of said piston and liner sealing surfaces to drive said piston away from said drill bit comprises at least three piston driving areas.

4. An hydraulically driven percussive hammer according to claim 2 wherein said group of said piston and liner sealing surfaces to drive said piston toward said drill bit comprises at least two said piston driving areas.

5. An hydraulically driven percussive hammer according to claim 2 wherein after engagement by one piston and liner sealing surface in one group and a subsequent engagement of a corresponding piston and liner sealing surface of the other group the preceding piston and liner sealing surfaces of the one group disengage and allow venting of fluid past its liner sealing surfaces.

6. An hydraulically driven percussive hammer according to claim 2 further comprising a plurality of venting conduits arranged such that as said piston moves away from said drill bit, the group of said piston driving areas displace fluid through said venting conduits.

7. An hydraulically driven percussive hammer according to claim 6 wherein said venting conduits are closed prior to said piston reaching the top of its movement which causes said piston to bounce against said fluid trapped by the closing of said venting conduit, thereby transferring a portion of the upwards stroke energy to the downward stroke.

8. An hydraulically driven percussive hammer according to claim 1 further comprising venting conduits that enable venting of high pressure fluid when the piston movement is decelerating or is stationary at the top or bottom of said reciprocating movement.

9. An hydraulically driven percussive hammer according to claim 1 wherein said fluid control means comprises a two position valve which changes position as said piston reaches its lower and uppermost movement to thereby control flow.

10. An hydraulically driven percussive hammer according to claim 9 wherein said hydraulic fluid is used to move said valve.

11. An hydraulically driven percussive hammer according to claim 10 wherein said valve has surfaces against which said hydraulic fluid acts to move said valve.

* * * * *